United States Patent [19]

Meyer, Jr.

[11] Patent Number: 5,054,612

[45] Date of Patent: Oct. 8, 1991

[54] FACIAL TISSUE SANITARY SYSTEM INCLUDING CLOSURE SEALER

[76] Inventor: Otto E. Meyer, Jr., 3507 Aston St., Annandale, Va. 22003

[21] Appl. No.: 147,936

[22] Filed: Nov. 7, 1988

[51] Int. Cl.[5] ..... B65D 71/00; B65H 1/00

[52] U.S. Cl. ..... 206/233; 221/34; 221/45; 221/102; 221/287; 229/11; 229/123.1; 229/125.37

[58] Field of Search ..... 206/233, 494, 459, 602; 220/23.83; 221/34, 35, 45, 102, 46–49, 287; 229/10, 11, 907, 125.37, 123.1

[56] References Cited

U.S. PATENT DOCUMENTS

| | | | |
|---|---|---|---|
| 1,764,673 | 6/1930 | Babson | 221/48 |
| 2,841,275 | 7/1958 | Schwimmer et al. | 221/34 X |
| 2,915,218 | 12/1959 | Rosenman et al. | 221/102 |
| 3,001,645 | 9/1961 | Hernberg | 221/34 |
| 3,072,245 | 1/1963 | Faltin | 221/34 |
| 3,095,087 | 6/1963 | Yates | 221/34 |
| 3,145,840 | 8/1964 | Wright | 206/494 |
| 3,221,928 | 12/1965 | Horn | 221/34 |
| 3,245,580 | 4/1966 | Campanella | 221/34 |
| 3,270,938 | 9/1966 | Rhinegold | 229/10 |
| 3,331,498 | 7/1967 | Davies | 206/494 X |
| 3,338,464 | 8/1967 | Callihan et al. | 220/306 |
| 3,372,837 | 3/1968 | Neumann | 221/102 |
| 4,066,167 | 1/1978 | Hanna et al. | 383/62 X |
| 4,131,195 | 12/1978 | Worrell, Jr. | 206/233 X |
| 4,919,302 | 4/1990 | McPherson | 221/34 |

*Primary Examiner*—Bryon P. Gehman

*Attorney, Agent, or Firm*—Birch, Stewart, Kolasch & Birch

[57] ABSTRACT

The facial tissue sanitary system is a unitized system having a container with a tissue dispensing section and a tissue disposal section, separated from one another by an intervening wall. Each section has a opening through which tissue passes, with a removable adhesive closure sealer provided for sealing of the tissue disposal opening. The container can be situated in a base over which a sleeve moves horizontally to cover the container, the sleeve having upper surface openings corresponding to the openings in the sections. A cover tray is provided to serve alternatively as a cover for the upper surface of the sleeve or a stand for the base, with an identity tag being optionally affixed to the closure lid. The closure sealer is useable to seal the refuse disposed in the tissue disposal section when the container is to be discarded. The construction of the system lends itself to greater sanitation in the work place not only for the user but also for the cleaning staff which collects the refuse generated by the user and fellow workers.

4 Claims, 3 Drawing Sheets

FACIAL TISSUE SANITARY SYSTEM INCLUDING CLOSURE SEALER

FIELD OF INVENTION

The invention relates to a facial tissue sanitary system for use primarily in the commercial workplace, though adaptable for private home or other site use. It comprises a unitized compartmented system in which tissue is dispensed from and disposed of in the same container, but using two separate areas thereof. In particular, the concerns of hygiene are addressed by this invention by providing a means for sealingly isolating the disposed tissues in a confined area.

The main object of this invention is to introduce to the corporate work-station person (primarily executives, secretaries, computer-terminal operators, etc.) a compact tissue system of personal gratification. The use of this system would be in the same category of personal relief, such as rest rooms with its corporate provided paper requirements.

It is another object of this invention to provide a unitized system capable of providing facial tissue and of disposing of used facial tissue in a sanitary manner. The sanitary manner of disposal pertains not only to the individual user but to the cleaning staff which would collect and dispose of the used facial tissue.

A problem that has troubled people for many a day, are those individuals who are seized with a sudden runny nose, then wonder what to do with the germ-laden yucky tissue they hold in their hand. It is either the wide-open waste basket, or a time-consuming small plastic bag kept in the drawer, or, the lady's handbag if she's in the middle of an emergency.

The store-bought "Softique" vertically dispensed tissue product seems to be the preference for office use. This product, because of its height, provides immediate access to tissues when needed in an emergency. The square base of the container allows more usable drawer space and also provides a softer, more desirable tissue than similar products.

Because of its proven advantages over the horizontal tissue containers, it is this product that inspired a my invention.

DESCRIPTION OF THE PREFERRED EMBODIMENT

Figure 1A:
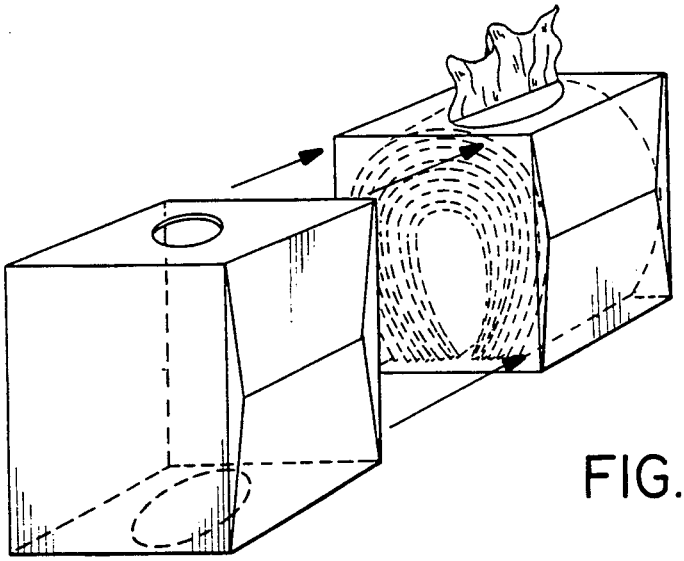
FIG. 1*a* illustrates the tissue dispensing area and the tissue disposing area of the container embodied in this invention.
Figure 1B:
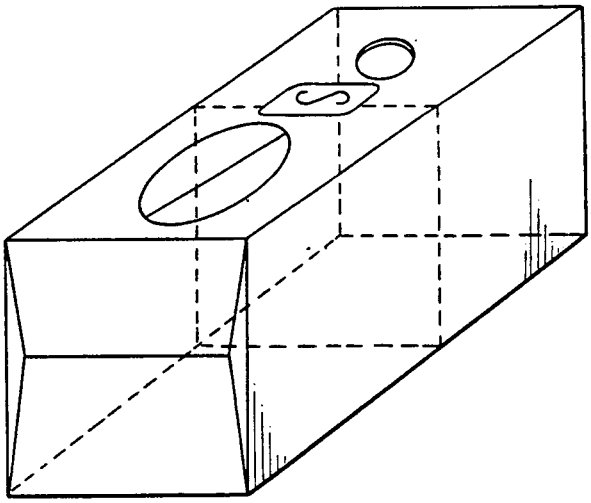
FIG. 1*b* illustrates the container embodiment with provision of the adhesive closure sealer on the upper surface.

An empty tissue container of the exact same dimensions as the "Softique" product was inverted and glued to a new full tissue container. A one- and one-sixteenth of an inch round hole was centered to the top of the empty box as a depository for used tissues. The two containers were then wrapped as a single unit to simulate a manufactured refill container, then two corresponding holes were cut through the wrapping and provide egress, ingress of tissues as shown in FIGS. 1*a* and 1*b*. A removable seal S having a surface area greater than the dimensions of the ingress hole is shown located between the egress hole and the ingress hole on the upper surface of the container.

Figure 2:
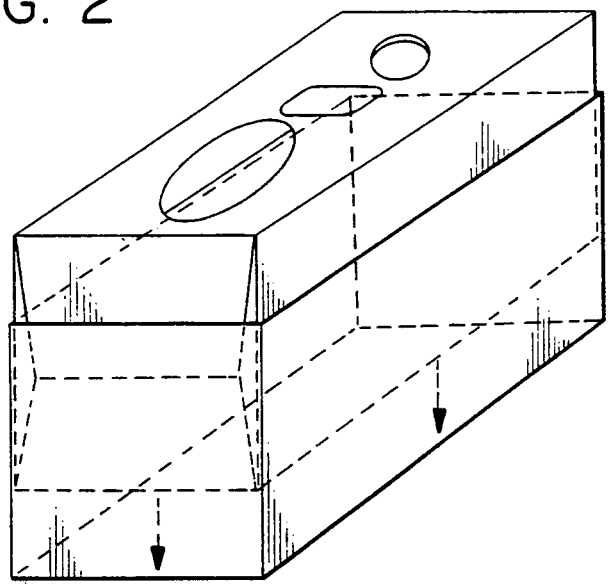
FIG. 2 illustrates the container-embodiment disposed in a base.

Next, a four-sided plastic walled container with a bottom made from the same material, but with no top, was constructed to accommodate the simulated refill unit as shown in FIG. 2.

Figure 3:
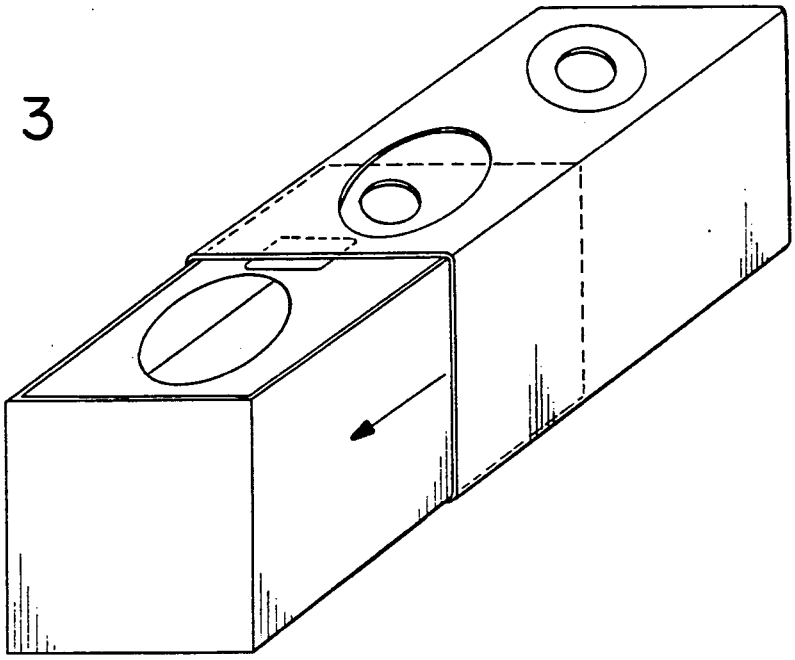
FIG. 3 illustrates the open-ended sleeve disposed about the base of FIG. 2.

Next, a rigid plastic sleeve with dimensions to accept the above four-sided container was constructed with openings on top to match the egress and ingress openings of the refill unit as shown in FIG. 3.

Figure 4:
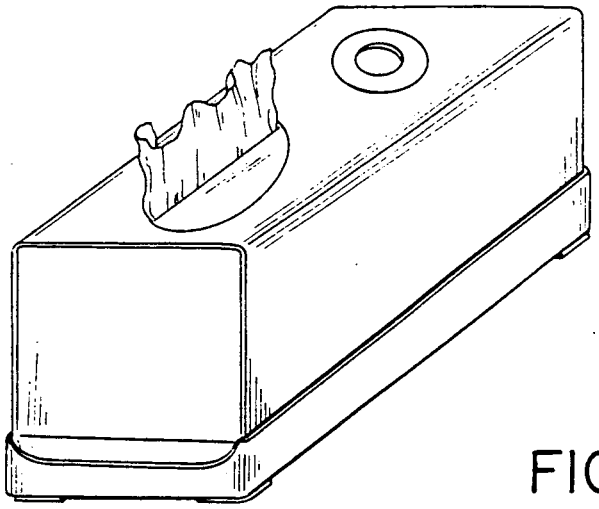
FIG. 4 illustrates the sleeve enclosing the base and seated in a cover tray.

The final segment to complete the system is a cover-tray combination fabricated from the same plastic material as the refill container and the sleeve unit as shown in FIG. 4.

The cover will be placed in position on top of the system, when the system is finished being used.

The three purposes of the cover's use are as follows:

1. It allows the system when covered, to be an acceptable, attractive addition to the surrounding decor, if no drawer is available for normal everyday use.
2. The cover protects the ingress the egress holes from incoming dust, and the escape into the air of cold germs when the system is not in use.
3. The cover will also act as a tray to provide bottom support to the system when in use. Its purpose is to keep the cover from being misplaced, and to be readily accessible when needed.

Figure 5:
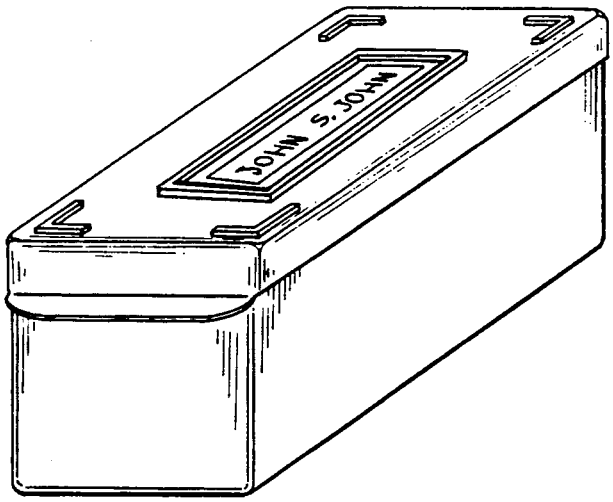
FIG. 5 illustrates the cover tray, with identification tag, of FIG. 4 situated surrounding the upper surface of the sleeve.

FIG. 5 shows the system in its non-use state, depicting the area where the work-station person's name will appear. A gold (metallic) looking frame will encompass a shallow trough, 4 inches long, to accept the first name, middle initial, and last name of person to which it is given. The names will be punched on plastic tape providing a professional-looking appearance. If the name is short, excess tape will appear before and after the name to fill the trough's length. If the name is long, the same procedure may be used. Additionally, as shown in FIGS. 4 and 5, each end wall of the tray has a handle portion.

Four-corner legs made of hard rubber, each measuring one-half inch by one-half inch by one-eighth of an inch high are shown in FIG. 5. Their purpose is to:

1. Protect the name frame from wear.
2. Keep the system from sliding when in use.
3. Allow the system to be easily picked up in case of a liquid spill.

SUMMATION

In providing an employee with a compact sanitary system of personal gratification, and with their names provided for in a professional appearing framed area, the employee perceives a feeling of personal recognition and at the same time gives him or her an added morale boost knowing the corporate sector is concerned about his or her well being as well as receiving an unwritten invitation to be an integral part of the organization. In return, the employee would give more valuable time and attention to his or her work assignments, thus satisfying the corporation's added expense of accepting the system.

A typical office scenario would be as follows: After an employee depletes his or her supply of tissues, he or she removes the system's refill unit, then from a designated area between the ingress and egress holes, a removable seal S (FIGS. 1*b* and 2) provided by the manufacturer would be used to cover the waste hole before disposing of the refill unit.

The employee would then walk over to a matching decor cabinet containing sliding doors, which when opened, will expose upper and lower sections of pigeonholes designed to completely accept the full length of new and used refill units. The upper section would be designated as the waste section for used refill units that would be removed nightly by chore personnel. The lower section would contain fresh new plastic-film wrapped refills stocked by chore personnel to maintain a continual supply of fresh tissues. It would take only a few short minutes to complete this operation of exchange. A plastic-film wrapping will envelope the entire container unit as a protective shield during shipment. The plastic-film wrapping would be disposed of by pushing same into the waste hole of the new refill unit. The system's waste product is 100% biodegradable with no germ exposure to chore personnel handling used refills for disposal.

What I claim is:

1. A facial tissue sanitary system comprising a container having a generally rectangular parallelepipedic shape including a first endwall, a second endwall, a first sidewall, a second sidewall, a bottom surface, an upper surface, the interior of said container being divided into a tissue dispensing section and a tissue disposing section by a dividing wall extending between said sidewalls and said upper and lower surfaces, said tissue dispensing section having a first opening in said upper surface to permit withdrawal of tissue therefrom, said tissue disposing section having a second opening in said upper surface to permit insertion of tissue therein, and a removable adhesive closure sealer disposed on said upper surface of said container, said closure sealer having a surface area greater than the dimensions of said second opening and being removable from said container and affixable to the perimeter area surrounding said second opening.

2. The system according to claim 1, further comprising a base for containing said container, said base having a first endwall, a second endwall, a first sidewall, a second sidewall, a lower wall, and an upper opening through which said container is inserted and removed with said upper surface of said container facing away from said lower wall.

3. The system according to claim 2, further comprising a sleeve having a first sidewall, a second sidewall, a bottom wall and a top wall, said top wall having a first opening and a second opening corresponding to said first and second openings of said container, respectively, said container being insertable into said sleeve whereby said first opening of said container and said first opening of said sleeve generally coincide to enable access to said tissue dispensing section, and said second opening of said container and said second opening of said sleeve generally coincide to enable access to said tissue disposing section.

4. The system according to claim 3, further comprising a cover tray, said tray including an identification area, and a first end and a second end, each said end having a handle portion, the interior dimensions of said tray generally corresponding to the dimensions of both said lower wall and said upper wall of said sleeve, whereby said cover tray can be used as a base for sealingly receiving said bottom wall of said sleeve and as a cover for said top wall of said sleeve, alternatively.

* * * * *